US010066520B2

(12) United States Patent
Noguchi et al.

(10) Patent No.: US 10,066,520 B2
(45) Date of Patent: Sep. 4, 2018

(54) VALVE OPENING AND CLOSING TIMING CONTROL APPARATUS

(71) Applicant: AISIN SEIKI KABUSHIKI KAISHA, Kariya-shi, Aichi (JP)

(72) Inventors: Yuji Noguchi, Obu (JP); Takeo Asahi, Kariya (JP)

(73) Assignee: AISIN SEIKI KABUSHIKI KAISHA, Kariya-Shi, Aichi (JP)

( * ) Notice: Subject to any disclaimer, the term of this patent is extended or adjusted under 35 U.S.C. 154(b) by 0 days.

(21) Appl. No.: 15/880,857

(22) Filed: Jan. 26, 2018

(65) Prior Publication Data

US 2018/0149045 A1 May 31, 2018

Related U.S. Application Data

(63) Continuation of application No. 15/118,206, filed as application No. PCT/JP2015/053901 on Feb. 13, 2015, now Pat. No. 9,903,237.

(30) Foreign Application Priority Data

Feb. 27, 2014 (JP) ..... 2014-037286

(51) Int. Cl.
*F01L 1/34* (2006.01)
*F01L 1/344* (2006.01)

(52) U.S. Cl.
CPC ..... *F01L 1/3442* (2013.01); *F01L 2001/3445* (2013.01); *F01L 2001/34426* (2013.01);
(Continued)

(58) Field of Classification Search
CPC ..... F01L 1/3442; F01L 2001/34433; F01L 2001/3445; F01L 2001/34479;
(Continued)

(56) References Cited

U.S. PATENT DOCUMENTS

2013/0008397 A1* 1/2013 Takada ..... F01L 1/3442 123/90.11
2013/0092113 A1 4/2013 Bohner et al.
(Continued)

FOREIGN PATENT DOCUMENTS

DE 10 2008 057 492 A1 5/2010
JP 2013-245596 A 12/2013
WO WO 2015/029476 A1 3/2015

OTHER PUBLICATIONS

International Search Report (PCT/ISA/210) dated Apr. 21, 2015 by the Japanese Patent Office as the International Searching Authority for International Application No. PCT/JP2015/053901.
(Continued)

*Primary Examiner* — Zelalem Eshete
(74) *Attorney, Agent, or Firm* — Buchanan Ingersoll & Rooney PC

(57) ABSTRACT

A valve opening and closing timing control apparatus includes a drive-side rotational member, a driven-side rotational member, an intermediate member abutting the driven-side rotational member, a mounting member connecting the driven-side rotational member and the intermediate member to the camshaft in a state being mounted at the camshaft, and a control valve mechanism arranged with a same axis as a rotation axis of the drive-side rotational member. The intermediate member includes an inner peripheral surface in contact with the outer peripheral surface of the mounting member. The flow passage includes an outlet flow passage provided at the intermediate member and positioned along a radial direction for sending out a fluid which is supplied to an inner peripheral surface of the intermediate member to an advanced angle chamber or a retarded angle chamber provided between the drive-side rotational member and the driven-side rotational member.

11 Claims, 5 Drawing Sheets

(52) U.S. Cl.
CPC ..... *F01L 2001/34433* (2013.01); *F01L 2001/34453* (2013.01); *F01L 2001/34479* (2013.01); *F01L 2001/34483* (2013.01)

(58) Field of Classification Search
CPC ... F01L 2001/34453; F01L 2001/34426; F01L 2001/34483
USPC ..... 123/90.17
See application file for complete search history.

(56) References Cited

U.S. PATENT DOCUMENTS

| | | | |
|---|---|---|---|
| 2017/0183984 | A1 | 6/2017 | Asahi et al. |
| 2017/0183987 | A1 | 6/2017 | Noguchi et al. |

OTHER PUBLICATIONS

Written Opinion (PCT/ISA/237) dated Apr. 21, 2015 by the Japanese Patent Office as the International Searching Authority for International Application No. PCT/JP2015/053901.

* cited by examiner

VALVE OPENING AND CLOSING TIMING CONTROL APPARATUS

CROSS REFERENCE TO RELATED APPLICATIONS

This application is a continuation application of U.S. patent application Ser. No. 15/118,206, filed on Aug. 11, 2016, which is U.S. National Stage application based on International Patent Application No. PCT/JP2015/053901, filed on Feb. 13, 2015, which claims priority to Japanese Application No. 2014-037286, filed on Feb. 27, 2014, the entire content of all three of which are incorporated herein by reference.

TECHNICAL FIELD

This invention relates to a valve opening and closing timing control apparatus, specifically, to a valve opening and closing timing control apparatus including a drive-side rotational member which rotates synchronously with a crankshaft of an internal combustion engine and a driven-side rotational member which is connected to an end of a camshaft for opening and closing a valve to integrally rotate with the camshaft, the valve opening and closing timing control apparatus including a control valve mechanism disposed on the same axis as a rotation axis of the camshaft.

BACKGROUND DISCUSSION

Japanese Patent Application Publication No. 2013-245596 discloses a construction where a driven-side rotational member (i.e., rotor in the document) disposed within a drive-side rotational member (i.e., housing in the document) is connected to a camshaft by a center bolt in a state where the driven-side rotational member is in contact with a front bushing, a vane rotor and a rear bushing in a rotation axis direction.

In Japanese Patent Application Publication No. 2013-245596, a control valve mechanism is constituted by a spool which is slidably movably supported in a direction along the rotation axis in a state where the spool is externally fitted to the center bolt. The control valve mechanism is constructed so that hydraulic oil is supplied from an inlet oil passage provided at the rear bushing.

In the known valve opening and closing timing control apparatus, supply and discharge of hydraulic oil relative to an advanced angle chamber and a retarded angle chamber changes a relative rotational phase between a drive-side rotational member and a driven-side rotational member. An opening and closing timing of an intake valve or an exhaust valve of an internal combustion engine is specified accordingly.

In the valve opening and closing timing control apparatus including the control valve mechanism at the inner portion of the driven-side rotational member as disclosed in Japanese Patent Application Publication No. 2013-245596, the oil passage for supplying the hydraulic oil to the control valve mechanism is provided at a region from the camshaft to the driven-side rotational member. The driven-side rotational member also includes an intermediate member.

The valve opening and closing timing control apparatus disclosed here exhibits a different construction compared to other known valve opening and closing timing control apparatus such as described above.

According to one aspect, the valve opening and closing timing control apparatus includes a drive-side rotational member rotatable about a rotation axis synchronously with a crankshaft of an internal combustion engine, a driven-side rotational member rotatable about the rotation axis and arranged at an inner side of the drive-side rotational member, with the driven-side rotational member being integrally rotatable with a camshaft for opening and closing a valve of the internal combustion engine; an intermediate member abutting against the driven-side rotational member; and a mounting member in which is located a supply void arranged on the rotation axis and to which fluid is supplied during operation of the valve opening and closing timing control apparatus. The mounting member penetrates through the driven-side rotational member and the intermediate member and possesses an outer surface, with the mounting member connecting the driven-side rotational member and the intermediate member to the camshaft when the valve opening and closing timing control apparatus is mounted at the camshaft. An advanced angle chamber and a retarded angle chamber are provided between the drive-side rotational member and the driven-side rotational member, and a control valve mechanism is arranged with the same axis as the rotation axis. A flow passage is provided to allow the fluid to selectively flow into the advanced angle chamber and the retarded angle chamber from the supply void or flow out from the advanced angle chamber and the retarded angle chamber via the control valve mechanism, such that the fluid flowing into the advanced angle chamber and the retarded angle chamber changes a relative rotational phase between the drive-side rotational member and the driven-side rotational member. The intermediate member includes an inner peripheral surface possessing an inner diameter, with the inner peripheral surface of the intermediate member contacting the outer peripheral surface of the mounting member. The flow passage extends from the supply void to the advanced angle chamber and to the retarded angle chamber. The flow passage includes an outlet flow passage provided at the intermediate member, with the outlet flow passage being positioned along a radial direction to direct the fluid which is supplied to the inner peripheral surface of the intermediate member to the advanced angle chamber or the retarded angle chamber.

The outlet flow passage may reach the outer peripheral surface from the inner peripheral surface.

Accordingly, the fluid may be supplied between the outer peripheral surface of the intermediate member and the inner peripheral surface of the drive-side rotational member. The fluid is supplied as lubrication oil between the intermediate member and the drive-side rotational member to thereby achieve a smooth relative rotation.

According to another aspect, a valve opening and closing timing control apparatus comprises: a drive-side rotational member rotatable about a rotation axis synchronously with a crankshaft of an internal combustion engine, a driven-side rotational member rotatable about the rotation axis and arranged at an inner side of the drive-side rotational member, with the driven-side rotational member being integrally rotatable with a camshaft for opening and closing a valve of the internal combustion engine, an intermediate member in contact with the driven-side rotational member, and a mounting member passing through the driven-side rotational member and the intermediate member. The mounting member connects the driven-side rotational member and the intermediate member to the camshaft when the valve opening and closing timing control apparatus is mounted at the camshaft. The mounting member includes an interiorly located supply void positioned so that the rotation axis passes through the supply void. An advanced angle chamber and a retarded angle chamber are located between the drive-side rotational member and the driven-side rotational member, and a control valve mechanism is arranged with an axis the same as the rotation axis. A flow passage is configured to allow a fluid to selectively flow into the advanced angle chamber and the retarded angle chamber via the control valve mechanism or flow out from the advanced angle chamber and the retarded angle chamber, with the fluid flowing into the advanced angle chamber and the retarded angle chamber changing a relative rotational phase between the drive-side rotational member and the driven-side rotational member. The intermediate member includes an inner peripheral surface that contacts the outer peripheral surface of the mounting member. The intermediate member includes a first side wall and a second side wall positioned at opposite axial ends of the intermediate member, with the first side wall of the intermediate member lying in a first plane and the second side wall of the intermediate member lying in a second plane. At least a part of the flow passage is provided at the intermediate member between the first and second planes and extending along a radial direction to direct the fluid which is supplied to the inner peripheral surface of the intermediate member to the advanced angle chamber or the retarded angle chamber.

DETAILED DESCRIPTION

An embodiment of the present invention is explained below with reference to drawings.

Basic Construction

Figure 1:
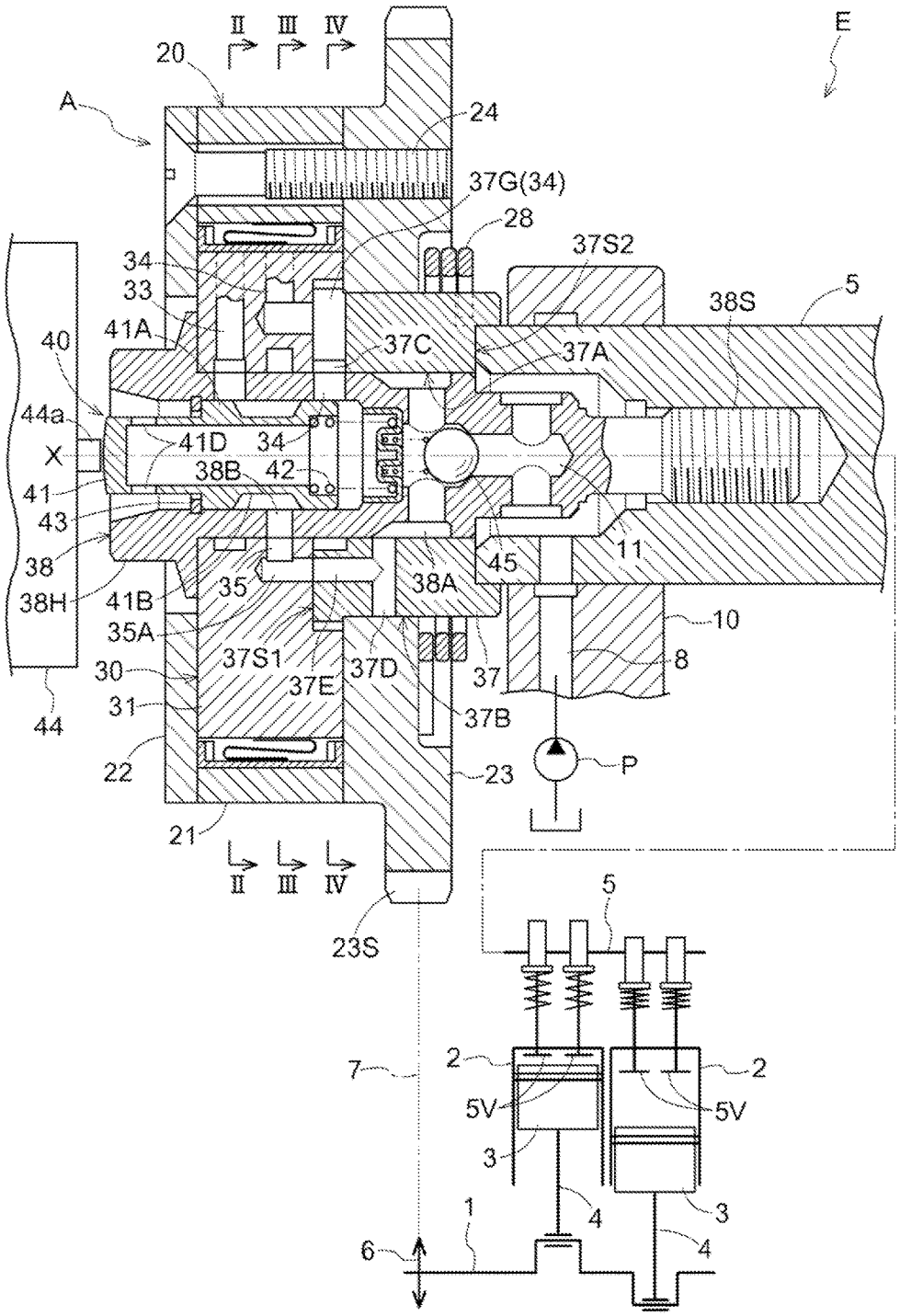
FIG. 1 is a cross-sectional view of a valve opening and closing timing control apparatus.
Figure 2:
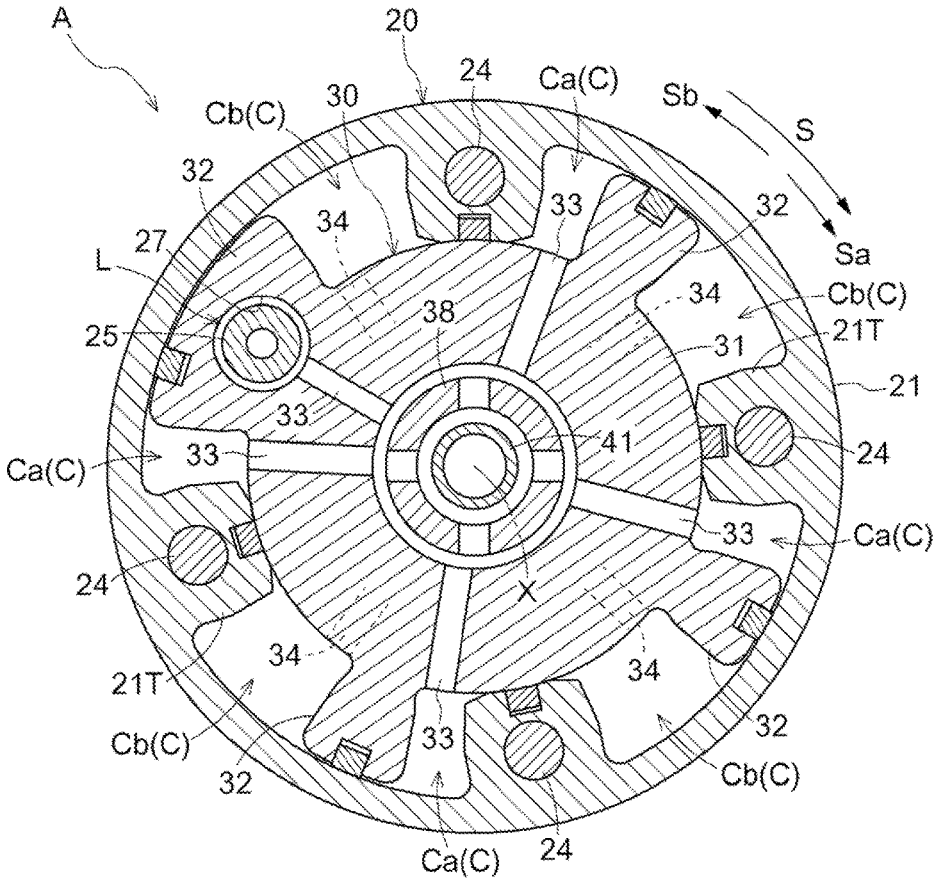
FIG. 2 is a cross-sectional view taken along a line II-II in FIG. 1.

As illustrated in FIGS. 1 and 2, a valve opening and closing timing control apparatus A is constituted by an outer rotor 20 (an example of a drive-side rotational member) rotating synchronously with a crankshaft 1 of an engine E serving as an internal combustion engine and an inner rotor 30 (an example of a driven-side rotational member) integrally rotating in a coaxial manner with an intake camshaft 5 in a combustion chamber of the engine E in a state where the outer rotor 20 and the inner rotor 30 are relatively rotatable about a rotation axis X of the intake camshaft 5.

The valve opening and closing timing control apparatus A includes an electromagnetic control valve 40 serving as a control valve mechanism at a center position of the inner rotor 30 with the same axis as the rotation axis X. The inner rotor 30 is disposed within the outer rotor 20. The valve opening and closing timing control apparatus A changes a relative rotational phase between the outer rotor 20 and the inner rotor 30 by a control of hydraulic oil (an example of fluid) by the electromagnetic control valve 40 to thereby control an opening and closing timing of an intake valve 5V.

FIG. 1 illustrates the engine E mounted at a vehicle such as a passenger automobile, for example. The engine E includes the crankshaft 1 at a lower portion. A piston 3 is housed within a cylinder bore provided at a cylinder block 2 at an upper position of the crankshaft 1. The piston 3 and the crankshaft 1 are connected to each other by a connecting rod 4 so that the engine E serves as a four-cycle engine.

The engine E includes, at an upper portion, the intake camshaft 5 and an exhaust camshaft (not illustrated) and includes a hydraulic pump P driven by a driving force of the crankshaft 1. The intake camshaft 5 is configured to open and close the intake valves 5V by rotating. The hydraulic pump P is configured to supply lubrication oil stored at an oil pan of the engine E to the electromagnetic control valve 40 as the hydraulic oil via a supply flow passage 8.

A timing chain 7 is wound across an output sprocket 6 provided at the crankshaft 1 of the engine E and a timing sprocket 23S. Thus, the outer rotor 20 is configured to synchronously rotate with the crankshaft 1. A sprocket, not illustrated, is also provided at a front end of the exhaust-side camshaft. The timing chain 7 is also wound at the aforementioned sprocket.

As illustrated in FIG. 2, in the valve opening and closing timing control apparatus A, the outer rotor 20 rotates in a driving rotation direction S by the driving force from the crankshaft 1. A direction where the inner rotor 30 rotates relative to the outer rotor 20 in the same direction as the driving rotation direction S is referred to as an advanced angle direction Sa and an opposite direction from the advanced angle direction Sa is referred to as a retarded angle direction Sb. In the valve opening and closing timing control apparatus A, a relationship between the crankshaft 1 and the intake camshaft 5 is specified so that an intake compression ratio increases with an increase of a displacement amount upon displacement of the relative rotational phase in the advanced angle direction Sa, and the intake compression ratio decreases with the increase of the displacement amount upon displacement of the relative rotational phase in the retarded angle direction Sb.

In the present embodiment, the valve opening and closing timing control apparatus A is provided at the intake camshaft 5. Alternatively, the valve opening and closing timing control apparatus A may be provided at the exhaust camshaft. Further alternatively, the respective valve opening and closing timing control apparatuses A may be provided at both the intake camshaft 5 and the exhaust camshaft.

Valve Opening and Closing Timing Control Apparatus

As illustrated in FIGS. 1 to 5, the valve opening and closing timing control apparatus A includes the outer rotor 20 and the inner rotor 30 and also includes an adapter 37 in a bush form serving as an intermediate member (an example of the intermediate member) at a position sandwiched between the inner rotor 30 and the intake camshaft 5. In the valve opening and closing timing control apparatus A, an outer rotor body 21 and an inner rotor body 31 are made of aluminum alloy while an adapter 37 is made of steel including iron.

The outer rotor 20 includes the outer rotor body 21, a front plate 22 and a rear plate 23, which are integrally provided by fastening of plural fastening bolts 24. The timing sprocket 23S is provided at an outer circumference of the rear plate 23.

The inner rotor 30 is disposed at a position sandwiched between the front plate 22 and the rear plate 23. Plural protruding portions 21T are integrally provided at the outer rotor body 21 so as to protrude inwardly in a radial direction with reference to the rotation axis X.

The inner rotor 30 includes the inner rotor body 31 in a column form which is tightly in contact with protruding ends of the respective protruding portions 21T of the outer rotor body 21 and plural (four) vane portions 32 which protrude at an outer circumference of the inner rotor body 31 so as to make contact with an inner peripheral surface of the outer rotor body 21.

Accordingly, the inner rotor 30 is arranged to be internally disposed relative to the outer rotor 20 so that plural hydraulic chambers C are defined at an outer circumferential side of the inner rotor body 31. Each of the hydraulic chambers C is disposed at an intermediate position of the adjacent protruding portions 21T in a rotation direction. Each of the hydraulic chambers C is divided by the vane portion 32 to obtain an advanced angle chamber Ca and a retarded angle chamber Cb.

Bore portions are provided at respective center portions of the inner rotor 30 and the adapter 37 with the center of the rotation axis X. A connection bolt 38 (an example of a mounting member) made of steel is inserted to be positioned within the bore portions. The connection bolt 38 includes a bolt head portion 38H and an externally threaded portion 38S. The externally threaded portion 38S is screwed to an internally threaded portion of the intake camshaft 5 to connect the inner rotor 30 to the intake camshaft 5.

Restriction pins 39 are fitted to positions at which the restriction pins 39 penetrate through a contact surface between the inner rotor 30 and the adapter 37 and a contact surface between the adapter 37 and the intake camshaft 5 in a state where the restriction pins 39 are positioned in parallel to the rotation axis X. As a result, the inner rotor 30, the adapter 37 and the intake camshaft 5 integrally rotate about the rotation axis X.

The connection bolt 38 is formed in a tubular form with reference to the rotation axis X. The electromagnetic control valve 40 is housed at an inner void of the connection bolt 38. A construction of the electromagnetic control valve 40 is explained later.

As illustrated in FIG. 1, a torsion spring 28 is provided across the adapter 37 and the front plate 22 for applying a biasing force to the relative rotational phase between the outer rotor 20 and the inner rotor 30 (hereinafter referred to as the relative rotational phase) from a most retarded angle phase to an intermediate lock phase which are explained later.

In addition, a lock mechanism L is provided to lock (fix) the relative rotational phase between the outer rotor 20 and the inner rotor 30 to a predetermined phase. The lock mechanism L is configured to include a lock member 25 guided in a protruding and retracting manner in a direction along the rotation axis X by a guide bore 27 provided at one of the vane portions 32, a lock spring biasing the lock member 25 to protrude and a lock recess portion provided at the rear plate 23.

In the lock mechanism L, the lock member 25 engages with the lock recess portion by a biasing force of the lock spring in a state where the relative rotational phase reaches the most retarded angle phase. The lock mechanism L thus functions as holding the relative rotational phase at the most retarded angle phase.

Valve Opening and Closing Timing Control Apparatus: Construction of Oil Passage A void for displacing the relative rotational phase to the advanced angle direction Sa with the supply of hydraulic oil is the advanced angle chamber Ca. On the other hand, a void for displacing the relative rotational phase to the retarded angle direction Sb with the supply of hydraulic oil is the retarded angle chamber Cb. The relative rotational phase in a state where the vane portion 32 reaches an operation end in the advanced angle direction Sa (including a phase in the vicinity of the operation end of the vane portion 32 in the advanced angle direction Sa) is referred to as a most advanced angle phase. The relative rotational phase in a state where the vane portion 32 reaches an operation end in the retarded angle direction Sb (including a phase in the vicinity of the operation end of the vane portion 32 in the retarded angle direction Sb) is referred to as the most retarded angle phase.

Advanced angle flow passages 33 in communication with the respective advanced angle chambers Ca and retarded angle flow passages 34 in communication with the respective retarded angle chambers Cb are provided at the inner rotor body 31. One of the advanced angle flow passages 33 is connected to the lock recess portion.

The valve opening and closing timing control apparatus A is configured so that the lock mechanism L reaches a locked state in a case where the relative rotational phase reaches the most retarded angle phase. In a case where the hydraulic oil is supplied to the advanced angle chambers Ca in the aforementioned locked state, the hydraulic oil is supplied to the lock recess portion from the advanced angle flow passage 33 so that the lock member 25 disengages from the lock recess portion against the biasing force of the lock spring, thereby releasing the locked state.

Electromagnetic Control Valve and Construction of Oil Passage

As illustrated in FIG. 1, the electromagnetic control valve 40 is configured by a spool 41, a spool spring 42 and an electromagnetic solenoid 44. That is, the spool 41 is arranged to be slidably movable in the direction along the rotation axis X within the inner void of the connection bolt 38. The connection bolt 38 includes a stopper 43 formed by a retaining ring for deciding an operation position of an outer end side of the spool 41. The spool spring 42 applies a biasing force in a direction where the spool 41 is separated from the intake camshaft 5.

The electromagnetic solenoid 44 includes a plunger 44*a* which operates to protrude by an amount proportional to an electric power supplied to a solenoid provided at an inside of the electromagnetic solenoid 44. The spool 41 is operated by a pressing force of the plunger 44*a*. The electromagnetic solenoid 44 is arranged at the outside of the valve opening and closing timing control apparatus A.

Accordingly, the spool 41 and the spool spring 42 integrally rotate with the inner rotor 30. The electromagnetic solenoid 44 which is supported at the engine E becomes non-rotatable.

Land portions 41A are provided at an inner end side (i.e., a side where the intake camshaft 5 is provided) and an outer end side. A groove portion 41B in an annular form is provided over an entire circumference at an intermediate position between the aforementioned land portions 41A. An inside of the spool 41 is formed to be hollow. A drain bore 41D is provided at a protruding end of the spool 41. In addition, the aforementioned plural (four) advanced angle flow passages 33 and the plural (four) retarded angle flow passages 34 are formed at the connection bolt 38 and the inner rotor body 31.

Figure 3:
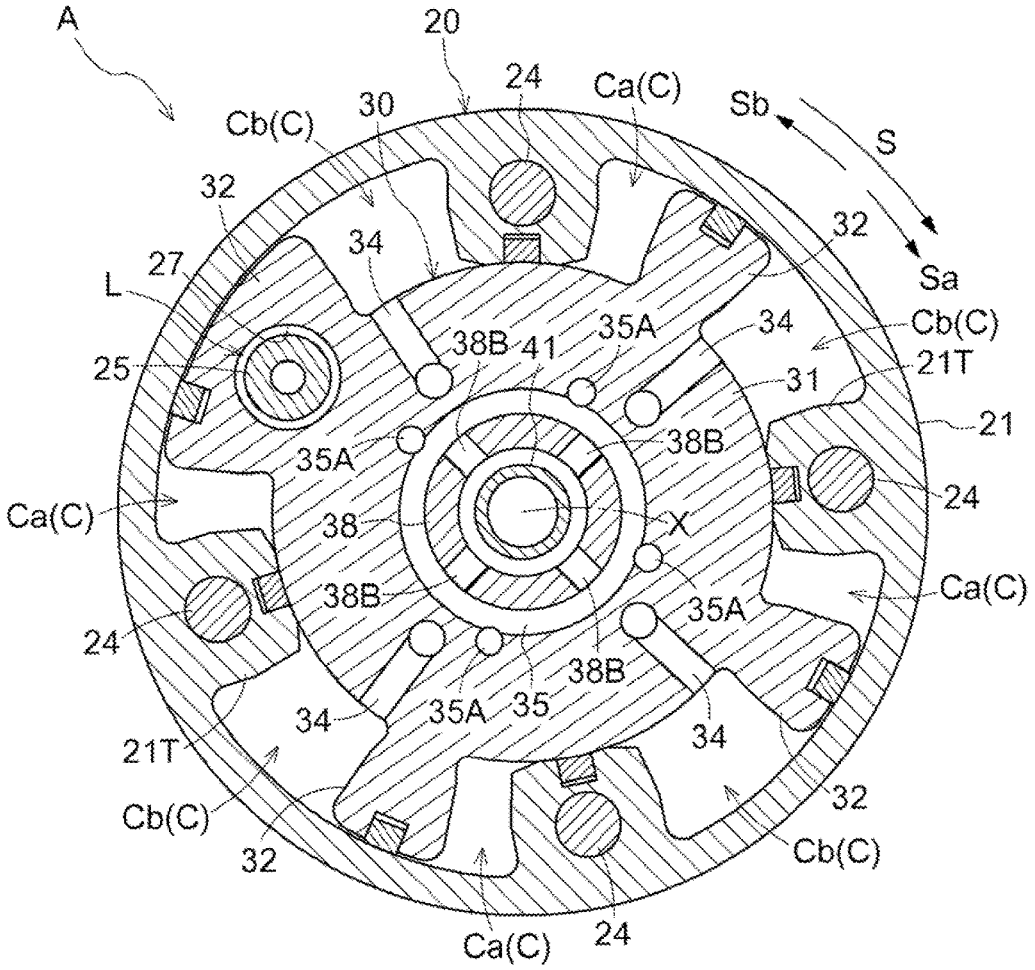
FIG. 3 is a cross-sectional view taken along a line in FIG. 1.
Figure 4:
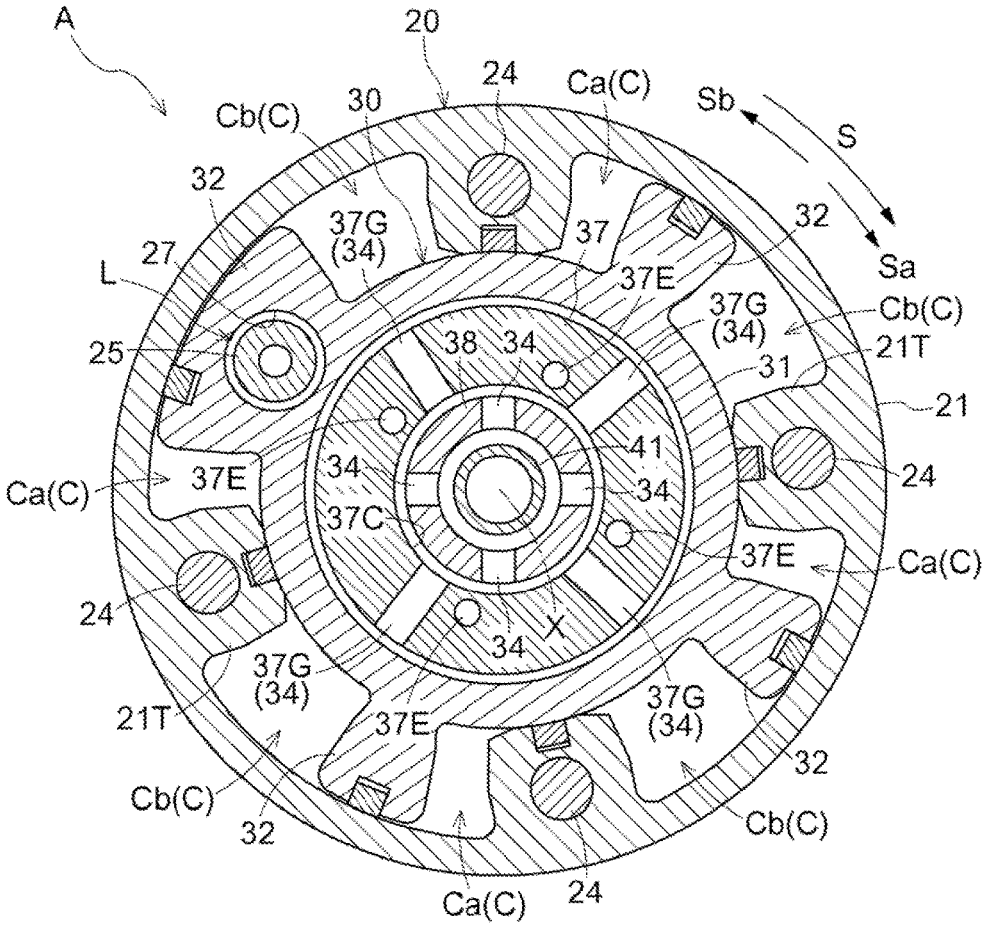
FIG. 4 is a cross-sectional view taken along a line IV-IV in FIG. 1.
Figure 5:
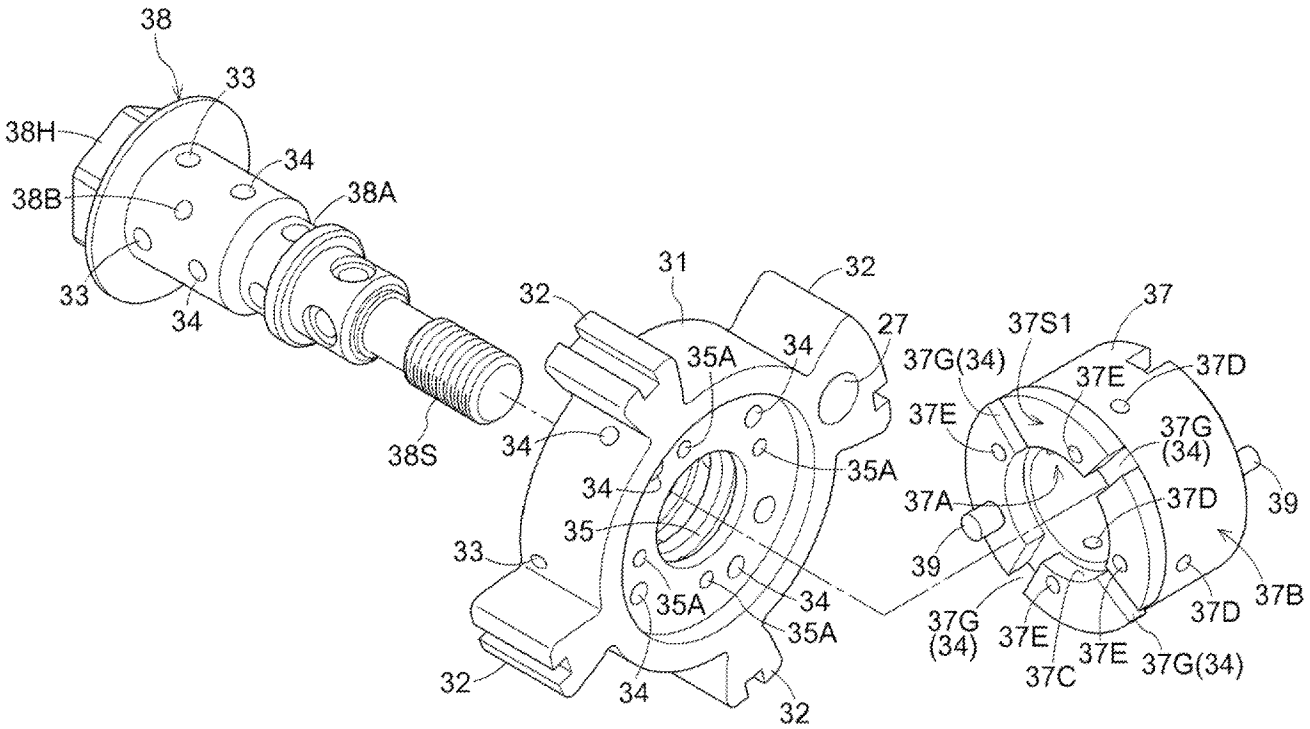
FIG. 5 is a perspective view of a connection bolt, an inner rotor and an adapter.

That is, each of the advanced angle flow passages 33 is formed in a bored manner from an outer circumference of the connection bolt 38 to the inner rotor body 31. Specifically, each of the retarded angle flow passages 34 is constituted, from the outer circumference of the connection bolt 38, by an annular recess portion 37C of the adapter 37, a groove portion 37G of the adapter 37 and a bore-formed portion bored at the inner rotor body 31 as illustrated in FIGS. 1, 3 and 4.

In the electromagnetic solenoid 44, the plunger 44*a* is arranged at a position contactable with an outer end of the spool 41. In a non-power supply state, the plunger 44*a* is retained at a non-pressing position as illustrated in FIG. 1 so that the spool 41 is retained at an advanced angle position as illustrated in FIG. 1. In a state where a predetermined electric power is supplied to the electromagnetic solenoid 44, the plunger 44*a* reaches a pressing position at an inner end side so that the spool 41 is retained at a retarded angle position. Further, in a state where a lower electric power than the predetermined electric power is supplied to the electromagnetic solenoid 44, the spool 41 is retained at a neutral position at which the protruding amount of the plunger 44*a* is restricted so that the spool 41 is retained at an intermediate position between the retarded angle position and the advanced angle position.

The supply flow passage 8 supplying the hydraulic oil from the hydraulic pump P is provided at an engine constituting member 10 which supports the intake camshaft 5 to be rotatable.

A supply void 11 is defined at the inside of the connection bolt 38 for supplying the hydraulic oil from the supply flow passage 8. A check valve 45 constituted by a spring and a ball is provided at the inside of the supply void 11. An intermediate recess portion 38A to which the hydraulic oil is supplied from the check valve 45 is provided at the outer circumference of the connection bolt 38 over an entire circumference. Further, a supply bore portion 38B is provided at the connection bolt 38 to be positioned at an outer portion of the spool 41 for supplying the hydraulic oil to the spool 41. An annular groove portion 35 in communication with the supply bore portion 38B is provided at an inner circumference of the inner rotor body 31.

The adapter 37 includes an inner peripheral surface 37A which includes an inner diameter so as to make contact with an outer peripheral surface of an intermediate portion of the connection bolt 38, an outer peripheral surface 37B in contact with an inner periphery of the rear plate 23, a first side wall 37S1 in contact with the inner rotor body 31 and a second side wall 37S2 in contact with the intake camshaft 5.

The adapter 37 is provided with plural (four) outlet flow passages 37D each of which is in a radial form for sending the hydraulic oil supplied to the inner peripheral surface 37A from the intermediate recess portion 38A of the connection bolt 38 to the outer peripheral surface 37B. Each of the outlet flow passages 37D is formed in a penetrating manner by drilling. The adapter 37 is provided with plural (four) branching flow passages 37E arranged in parallel to the rotation axis X for sending the hydraulic oil from each of the outlet flow passages 37D towards the first side wall 37S1.

In the inner rotor body 31, plural (four) extension flow passages 35A which are linearly connected to the plural (four) branching flow passages 37E are provided in a state being in communication with the annular groove portion 35.

The annular recess portion 37C is formed by cutting a portion of the inner peripheral surface 37A of the adapter 37, the portion facing the first side wall 37S1. The annular recess portion 37C is disposed at a position being in communication with the retarded angle flow passages 34 which are formed in bores at the connection bolt 38. The plural groove portions 37G are radially formed at the first side wall 37S1 in a range from the annular recess portion 37C to the outer peripheral surface 37B. Each of the groove portions 37G constitutes a portion of each of the retarded angle flow passages 34.

Accordingly, the hydraulic oil from the hydraulic pump P is supplied to the supply void 11 through the supply flow passage 8 and further to the intermediate recess portion 38A through the check valve 45. The hydraulic oil supplied to the intermediate recess portion 38A is sent to the plural outlet flow passages 37D from the inner peripheral surface 37A of the adapter 37 and is supplied to the groove portion 41B of the spool 41 sequentially through the branching flow passages 37E in communication with the outlet flow passages 37D, the extension flow passages 35A, the annular groove portion 35 and the supply bore portion 38B.

Because the hydraulic oil is supplied in the aforementioned manner, the hydraulic oil is supplied from the advanced angle flow passages 33 to the respective advanced angle chambers Ca while the hydraulic oil in the retarded angle chambers Cb is returned to the inner void of the spool 41 in a case where the spool 41 is in the advanced angle position. Because the retarded angle flow passages 34 are constructed in the aforementioned manner, the hydraulic oil in the retarded angle chambers Cb flows from the retarded angle flow passages 34 of the inner rotor body 31 to the groove portions 37G (retarded angle flow passages 34) of the adapter 37 and to the annular recess portion 37C (retarded angle flow passages 34) of the adapter 37.

Accordingly, the relative rotational phase is displaced to the advanced angle direction Sa. At this time, in a case where the hydraulic oil is supplied to the advanced angle chambers Ca in a state where the lock mechanism L is in the locked state, the hydraulic oil is supplied to the lock recess portion. Thus, the pressure of the hydraulic oil at the lock recess portion causes the lock member 25 to disengage from the lock recess portion. The relative rotational phase is shifted to the advanced angle direction Sa after the lock mechanism L reaches a lock release state.

In addition, in a case where the spool 41 is operated to the retarded angle position, the hydraulic oil is supplied to the respective retarded angle chambers Cb from the retarded angle flow passages 34 while the hydraulic oil at the advanced angle chambers Ca is discharged directly from the outer end of the spool 41 via the advanced angle flow passages 33. In a case where the hydraulic oil flows to the retarded angle flow passages 34, the hydraulic oil flows from the annular recess portion 37C (retarded angle flow passage 34) of the adapter 37 to the groove portions 37G (retarded angle flow passages 34) of the adapter 37 and to the retarded angle flow passages 34 of the inner rotor body 31. As a result, the relative rotational phase is shifted to the retarded angle direction Sb.

The hydraulic oil supplied to the inner peripheral surface 37A of the adapter 37 is supplied to the outer peripheral surface 37B of the adapter 37 by the plural outlet flow passages 37D so that lubrication is obtained between the outer peripheral surface 37B of the adapter 37 and the inner peripheral surface of the rear plate 23.

For example, in a case where the inner rotor body 31 emits heat in circumstances where the connection bolt 38 expands by heat effect of the hydraulic oil, it is considerable that a small gap may be defined between the inner rotor body 31 and the adapter 37 based on a difference in thermal expansion rate of the inner rotor body 31 and the adapter 37. In a case where such gap is formed, positions of the inner rotor body 31 and the adapter 37 may not be maintained at predetermined positions in the direction along the rotation axis X.

In the light of the aforementioned inconvenience, the pressure of the hydraulic oil flowing to the groove portions 37G provided at the first side wall 37S1 of the adapter 37 is configured to be applied in a direction where the inner rotor body 31 and the adapter 37 are separated from each other. Accordingly, even in the circumstances where the gap may be formed due to the difference in thermal expansion rate, the pressure of the hydraulic oil is utilized to restrain a phenomenon where the inner rotor body 31 and the adapter 37 are brought to an unstable positional relationship.

Effects of Embodiment

According to the present invention, because the adapter 37 is employed, the flow passage is easily provided as compared to a case where the flow passage is provided at the inner rotor body 31. In addition, in a case where the flow passage provided at the adapter 37 is obtained as a penetration bore for supplying the hydraulic oil from the intake camshaft 5 to the inner rotor body 31 in a manner that the penetration bore is positioned in parallel to the rotation axis X, for example, a leakage of hydraulic oil may occur at a boundary portion between the adapter 37 and the intake camshaft 5 or at a boundary portion between the adapter 37 and the inner rotor body 31. On the other hand, according to the present invention, the hydraulic oil supplied from the inner peripheral surface 37A is supplied to the outlet flow passages 37D provided between the first side wall 37S1 and the second side wall 37S2 at the adapter 37 so that possibility of leakage is reduced and displacement of the relative rotational phase may be securely performed.

In addition, as compared to a construction where an annular groove is provided at the inner peripheral surface 37A of the adapter 37 over an entire circumference so as to supply the fluid to the outside via the annular groove, according to the construction of the invention, the outlet flow passages 37D are formed in bores relative to the inner peripheral surface 37A of the adapter 37. Thus, a region where the hydraulic oil makes contact with a boundary with the outer peripheral surface of the connection bolt 38 is smaller than a region in the case of the annular groove. Accordingly, inconvenience where the hydraulic oil leaks in the direction along the rotation axis X between the inner peripheral surface 37A of the adapter 37 and the outer peripheral surface of the connection bolt 38 may be eliminated.

In addition, each of the outlet flow passages 37D is formed as a penetration bore from the inner peripheral surface 37A to the outer peripheral surface 37B so that the hydraulic oil is supplied between the outer peripheral surface 37B of the adapter 37 and the outer rotor 20. Thus, a smooth operation of the relative rotational phase is achieved.

Further, even in circumstances where the position of the adapter 37 or the inner rotor body 31 in the direction along the rotation axis X is unstable due to a difference in thermal expansion rate, the position may be stabilized by the pressure of the hydraulic oil flowing to the groove portions 37G of the adapter 37.

Other Embodiments

The embodiment of the present invention may be constructed as follows other than the aforementioned embodiment.

(a) Each of the outlet flow passages 37D provided at the adapter 37 may be formed as a non-penetration bore not reaching the outer peripheral surface 37B. That is, the outlet flow passage 37D may be formed from the inner peripheral surface 37A to an intermediate position in a radial direction of the adapter 37. Then, a flow passage (in the present embodiment, corresponding to the branching flow passage 37E) may be formed for introducing the hydraulic oil from the aforementioned intermediate position to the direction of the inner rotor body 31.

As a specific processing for forming the outlet flow passage 37D as the non-penetration bore, drilling from an oblique direction relative to the inner peripheral surface 37A of the adapter 37 (i.e., inclined direction relative to the rotation axis X) may be considered. In addition, it may be considered that the outlet flow passage 37D is formed in a penetration manner in the same way as in the present embodiment and thereafter an opening of the outlet flow passage 37D at the outer peripheral surface side is covered by a plug, for example.

(b) In order to improve lubrication ability at the outer peripheral surface 37B, an exclusive penetration bore which reaches the outer peripheral surface 37B from the inner peripheral surface 37A may be provided at the adapter 37. Accordingly, the hydraulic oil is positively supplied to the outer peripheral surface 37B to achieve an improved lubrication.

(c) The groove portion 37G exclusive for applying the pressure of the hydraulic oil to a boundary position between the adapter 37 and the inner rotor body 31 may be provided at the first side wall 37S1 of the adapter 37. Because of the aforementioned groove portion 37G, the pressure is constantly applied between the inner rotor body 31 and the adapter 37 regardless of the position of the spool 41 so as to restrain inconvenience where the positions of the inner rotor body 31 and the adapter 37 are unstable.

INDUSTRIAL AVAILABILITY

The present invention is applicable to a valve opening and closing timing control apparatus including a construction where an intermediate member is sandwiched between a driven-side rotational member and a camshaft.

EXPLANATION OF REFERENCE NUMERALS

1 crankshaft
5 camshaft (intake camshaft)
20 drive-side rotational member (outer rotor)
30 driven-side rotational member (inner rotor)
37 intermediate member (adapter)
37A inner peripheral surface
37B outer peripheral surface
37D outlet flow passage
37E branching flow passage
37G groove portion
37S1 first side wall
37S2 second side wall
38 mounting member (connection bolt)
40 control valve mechanism (electromagnetic control valve)
Ca advanced angle chamber
Cb retarded angle chamber
E internal combustion engine (engine)
X rotation axis

What is claimed is:

1. A valve opening and closing timing control apparatus comprising:

a drive-side rotational member rotatable about a rotation axis synchronously with a crankshaft of an internal combustion engine;

a driven-side rotational member rotatable about the rotation axis and arranged at an inner side of the drive-side rotational member, the driven-side rotational member being integrally rotatable with a camshaft for opening and closing a valve of the internal combustion engine;

an intermediate member abutting against the driven-side rotational member;

a mounting member in which is located a supply void to which fluid is supplied during operation of the valve opening and closing timing control apparatus, the mounting member penetrating through the driven-side rotational member and the intermediate member and possessing an outer surface, the mounting member connecting the driven-side rotational member and the intermediate member to the camshaft when the valve opening and closing timing control apparatus is mounted at the camshaft, the supply void in the mounting member being arranged on the rotation axis;

an advanced angle chamber and a retarded angle chamber provided between the drive-side rotational member and the driven-side rotational member;

a control valve mechanism arranged with a same axis as the rotation axis;

a flow passage provided to allow the fluid to selectively flow into the advanced angle chamber and the retarded angle chamber from the supply void or flow out from the advanced angle chamber and the retarded angle chamber via the control valve mechanism, the fluid flowing into the advanced angle chamber and the retarded angle chamber changing a relative rotational phase between the drive-side rotational member and the driven-side rotational member;

the intermediate member including an inner peripheral surface possessing an inner diameter, the inner peripheral surface of the intermediate member contacting the outer peripheral surface of the mounting member; and the flow passage connecting the supply void to the advanced angle chamber and to the retarded angle chamber, the flow passage including an outlet flow passage provided at the intermediate member, the outlet flow passage being positioned along a radial direction to direct the fluid which is supplied to the inner peripheral surface of the intermediate member to the advanced angle chamber or the retarded angle chamber.

2. The valve opening and closing timing control apparatus according to claim 1, wherein the intermediate member possesses an outer peripheral surface, the outlet flow passage extending from the outer peripheral surface of the intermediate member to the inner peripheral surface of the intermediate member so that the outlet flow passage opens to both the outer peripheral surface of the intermediate member and the inner peripheral surface of the intermediate member.

3. The valve opening and closing timing control apparatus according to claim 1, wherein the intermediate member possesses a first side wall at one axial end of the intermediate member and a second side wall at an opposite axial end of the intermediate member, the outlet flow passage being positioned between the first side wall of the intermediate member and the second side wall of the intermediate member.

4. The valve opening and closing timing control apparatus according to claim 3, wherein the first side wall is in contact with the driven-side rotational member and the second side wall is in contact with the camshaft in the state of being mounted at the camshaft.

5. The valve opening and closing timing control apparatus according to claim 1, wherein the outlet flow passage is a through hole in the intermediate member.

6. The valve opening and closing timing control apparatus according to claim 1, wherein the outlet flow passage is a first outlet flow passage, the intermediate member including a plurality of additional outlet flow passages each positioned along the radial direction to direct the fluid which is supplied to the inner peripheral surface of the intermediate member to the advanced angle chamber or the retarded angle chamber.

7. A valve opening and closing timing control apparatus comprising:

a drive-side rotational member rotatable about a rotation axis synchronously with a crankshaft of an internal combustion engine;

a driven-side rotational member rotatable about the rotation axis and arranged at an inner side of the drive-side rotational member, the driven-side rotational member being integrally rotatable with a camshaft for opening and closing a valve of the internal combustion engine;

an intermediate member in contact with the driven-side rotational member;

a mounting member passing through the driven-side rotational member and the intermediate member, the mounting member connecting the driven-side rotational member and the intermediate member to the camshaft when the valve opening and closing timing control apparatus is mounted at the camshaft, the mounting member including an interiorly located supply void positioned so that the rotation axis passes through the supply void;

an advanced angle chamber and a retarded angle chamber between the drive-side rotational member and the driven-side rotational member;

a control valve mechanism arranged with an axis the same as the rotation axis;

a flow passage configured to allow a fluid to selectively flow into the advanced angle chamber and the retarded angle chamber via the control valve mechanism or flow out from the advanced angle chamber and the retarded angle chamber, the fluid flowing into the advanced angle chamber and the retarded angle chamber changing a relative rotational phase between the drive-side rotational member and the driven-side rotational member;

the intermediate member including an inner peripheral surface that contacts an outer peripheral surface of the mounting member, the intermediate member including a first side wall and a second side wall positioned at opposite axial ends of the intermediate member, the first side wall of the intermediate member lying in a first plane and the second side wall of the intermediate member lying in a second plane; and at least a part of the flow passage being provided at the intermediate member between the first and second planes and extending along a radial direction to direct the fluid which is supplied to the inner peripheral surface of the intermediate member to the advanced angle chamber or the retarded angle chamber.

8. The valve opening and closing timing control apparatus according to claim 7, wherein the part of the flow passage provided at the intermediate member between the first and second planes extends from the outer peripheral surface of the intermediate member to the inner peripheral surface of the intermediate member so that the part of the flow passage opens to both the outer peripheral surface of the intermediate member and the inner peripheral surface of the intermediate member.

9. The valve opening and closing timing control apparatus according to claim 7, wherein the part of the flow passage provided at the intermediate member between the first and second planes is provided at an intermediate portion of the intermediate member that is spaced from both the first side wall of the intermediate member and the second side wall of the intermediate member.

10. The valve opening and closing timing control apparatus according to claim 7, wherein the part of the flow passage provided at the intermediate member between the first and second planes is a through hole in the intermediate member.

11. The valve opening and closing timing control apparatus according to claim 7, wherein the part of the flow passage is a first outlet flow passage, the intermediate member including a plurality of additional outlet flow passages each positioned along the radial direction to direct the fluid which is supplied to the inner peripheral surface of the intermediate member to the advanced angle chamber or the retarded angle chamber.

* * * * *